US011125463B2

(12) United States Patent
Sun et al.

(10) Patent No.: US 11,125,463 B2
(45) Date of Patent: Sep. 21, 2021

(54) AIR SWEEPING BLADE, AIR SWEEPING MECHANISM AND AIR CONDITIONER

(71) Applicant: GREE ELECTRIC APPLIANCES, INC. OF ZHUHAI, Guangdong (CN)

(72) Inventors: Shuaihui Sun, Guangdong (CN); Zhi Meng, Guangdong (CN); Tao Liang, Guangdong (CN)

(73) Assignee: GREE ELECTRIC APPLIANCES, INC. OF ZHUHAI, Zhuhai (CN)

( * ) Notice: Subject to any disclaimer, the term of this patent is extended or adjusted under 35 U.S.C. 154(b) by 105 days.

(21) Appl. No.: 16/687,942

(22) Filed: Nov. 19, 2019

(65) Prior Publication Data

US 2020/0088441 A1 Mar. 19, 2020

Related U.S. Application Data

(63) Continuation of application No. 15/506,977, filed as application No. PCT/CN2015/084500 on Jul. 20, 2015, now Pat. No. 10,520,215.

(30) Foreign Application Priority Data

Aug. 27, 2014 (CN) ..... 201410428765.5

(51) Int. Cl.
*F24F 13/15* (2006.01)

(52) U.S. Cl.
CPC ..... *F24F 13/15* (2013.01)

(58) Field of Classification Search
CPC .. F24F 13/15; F24F 13/14; F24F 13/10; F24F 13/075
USPC ..... 454/333, 335, 336, 109, 325, 326
See application file for complete search history.

(56) References Cited

U.S. PATENT DOCUMENTS 1,725,353 A * 8/1929 Hinrich ..... F24F 13/075 454/320
2,220,833 A * 11/1940 Young ..... F24F 13/15 454/335
5,186,387 A * 2/1993 Doi ..... B60H 1/00871 236/49.3

(Continued)

FOREIGN PATENT DOCUMENTS

CN 202267188 U 6/2012
CN 202267188 * 8/2012

(Continued)

*Primary Examiner* — Vivek K Shirsat
*Assistant Examiner* — Ko-Wei Lin
(74) *Attorney, Agent, or Firm* — Novick, Kim & Lee, PLLC; Sang Ho Lee; Hyun Woo Shin

(57) ABSTRACT

Provided are an air sweeping blade, an air sweeping mechanism and an air conditioner. The air sweeping blade includes a blade body (11). A connecting rod shaft (13) rotationally connected with a connecting rod (20) is provided on the blade body (11), and the connecting rod shaft (13) extends to an edge of the blade body (11) along an axis of the connecting rod shaft and is fixedly connected with the blade body (11). By means of the structure, on one hand, the reliability of connection between the connecting rod shaft (13) and the blade body (11) is improved, and the condition of breakage caused by pulling during assembly is avoided; and on the other hand, the rigidity of the blade body (11) is improved, and the blade body (11) is prevented from distorting.

10 Claims, 6 Drawing Sheets

(56) References Cited

U.S. PATENT DOCUMENTS

| | | | | |
|---|---|---|---|---|
| 2009/0072496 | A1* | 3/2009 | Kim | H01M 8/0286 277/637 |
| 2012/0289140 | A1* | 11/2012 | Marx | B60H 1/28 454/162 |
| 2013/0029583 | A1* | 1/2013 | Zhang | F24F 1/0011 454/333 |
| 2014/0045418 | A1* | 2/2014 | Schneider | B60H 1/00678 454/155 |
| 2014/0248831 | A1* | 9/2014 | Kim | F24F 12/006 454/239 |

FOREIGN PATENT DOCUMENTS

| | | | | |
|---|---|---|---|---|
| CN | 102853521 | A | | 1/2013 |
| CN | 202648077 | U | | 1/2013 |
| CN | 103307726 | A | | 9/2013 |
| CN | 203274175 | U | | 11/2013 |
| CN | 103542508 | A | | 1/2014 |
| CN | 203375643 | U | | 1/2014 |
| CN | 203375644 | U | | 1/2014 |
| CN | 104236043 | A | | 12/2014 |
| CN | 204227653 | U | | 3/2015 |
| EP | 2557371 | A1 | | 2/2013 |
| JP | 10103750 | A | | 4/1998 |
| JP | 2009074758 | A | * | 4/2009 |
| JP | 2009-299991 | A | | 12/2009 |
| JP | 2012-193916 | A | | 10/2012 |
| WO | 2011/020420 | A1 | | 2/2011 |

* cited by examiner

AIR SWEEPING BLADE, AIR SWEEPING MECHANISM AND AIR CONDITIONER

CROSS-REFERENCE TO RELATED APPLICATIONS

The instant application is a continuation application of U.S. patent application Ser. No. 15/506,977 filed on Feb. 27, 2017, which is a national-stage application under 35 USC 371 of international application No. PCT/CN2015/084500 filed on Jul. 20, 2015, and claims priority to Chinese patent application No. 201410428765.5 filed on Aug. 27, 2014, the entire disclosures of which are hereby incorporated by reference.

TECHNICAL FIELD OF THE INVENTION

The invention relates to the field of air conditioners, and in particular to an air sweeping blade, an air sweeping mechanism and an air conditioner.

BACKGROUND OF THE INVENTION

In the prior art, an air sweeping blade of an air sweeping mechanism of an air conditioner has a rigid blade and a flexible blade two forms generally. The rigid blade is rotationally connected with a connecting rod and a blade clamping board, thus realizing rotational air sweeping. The flexible blade is fixedly connected with the blade clamping board and is rotationally connected with the connecting rod, thus realizing air sweeping by flexible bending.

However, a connecting rod which is rotationally connected with a connecting rod shaft and an existing sweeping blade are generally independent structure. That is, an assembly groove matched with the connecting rod is provided on the blade, and two ends of the connecting rod shaft are connected with two sides of the assembly groove. Since the blade is thinner, the connecting strength is not enough, the condition of breakage of connection between the connecting rod shaft and the blade caused by pulling easily happens during final assembly, and the usage reliability is reduced.

Besides, the existing flexible blade has the defect of breakage at a flexible bending part, and the structure needs to be further optimized.

SUMMARY OF THE INVENTION

The invention aims to provide an air sweeping blade can improve the structural strength and an air sweeping mechanism, an air conditioner.

The invention provides an air sweeping blade, which comprises a blade body. A connecting rod shaft rotationally connected with a connecting rod is provided on the blade body, and the connecting rod shaft extends to an edge of the blade body along an axis of the connecting rod shaft and is fixedly connected with the blade body.

Further, the connecting rod shaft and the blade body are integrally formed.

Further, the blade body has a flexible area, a length direction of the flexible area is parallel to an axis direction of the connecting rod shaft, a width direction of the flexible area is vertical to the axis direction of the connecting rod shaft, and the flexible area has an opening extending along the length direction thereof.

Further, the width of the flexible area is c, the length of the flexible area is e, and $e/4 \le c \le e/3$.

Further, there is one opening, and the width of the opening is a, wherein $c/4 \le a \le c/3$.

Further, the length b of the opening satisfies a formula:

$$M = \frac{yE(e-b)d^3}{12},$$

wherein d is the thickness of the flexible area, M is a preset force moment, E is an elastic model of a material of the flexible area, and y is a preset offset of the blade body.

The invention also provides an air sweeping mechanism, which comprises a blade clamping board, a connecting rod and a motor assembly for driving the connecting rod. Multiple aforementioned air sweeping blades are provided on the blade clamping board. Connecting rod shafts of the multiple air sweeping blades are rotationally connected with the connecting rod.

Further, a rotational clamping groove is provided on the connecting rod, and a connecting rod shaft is clamped into the rotational clamping groove.

Further, a clamping hole is provided on the blade clamping board, and a clamping jaw clamping fixed with the clamping hole is provided on the air sweeping blade.

The invention also provides an air conditioner, which comprises a base. The aforementioned air sweeping mechanism is provided on the base.

According to the air sweeping blade, the air sweeping mechanism and the air conditioner of the invention, the connecting rod shaft extends to the edge of the blade body along the axis and is fixedly connected with the blade body. On one hand, the problem of connection between the connecting shaft and the blade body is solved, the reliability is improved, and the condition of breakage caused by pulling during assembly is avoided; and on the other hand, the connecting rod shaft extends to the edge of the blade body and also serves as a reinforcement rib of the blade body, thereby improving the rigidity of the blade body, and preventing the blade body from distorting.

BRIEF DESCRIPTION OF THE DRAWINGS

The drawings forming a part of the application are intended to provide further understanding of the invention. The schematic embodiments and descriptions of the invention are intended to explain the invention, and do not form improper limits to the invention. In the drawings.

DRAWING MARKS

10, air sweeping blade; 11, blade body; 12, assembly groove; 13, connecting rod shaft; 14, flexible area; 15, opening; 16, clamping jaw; 20, connecting rod; 30, blade clamping board; 40, motor assembly; 1, base; and 21, clamping groove.

DETAILED DESCRIPTION OF THE EMBODIMENTS

The invention will be described below with reference to the drawings and the embodiments in detail.

As shown in FIGS. 1 to 10, an air sweeping blade according to the invention comprises a blade body 11. A connecting rod shaft 13 rotationally connected with a connecting rod 20 is provided on the blade body 11, and the connecting rod shaft 13 extends to an edge of the blade body 11 along an axis of the connecting rod shaft and is fixedly connected with the blade body 11.

Figure 4:
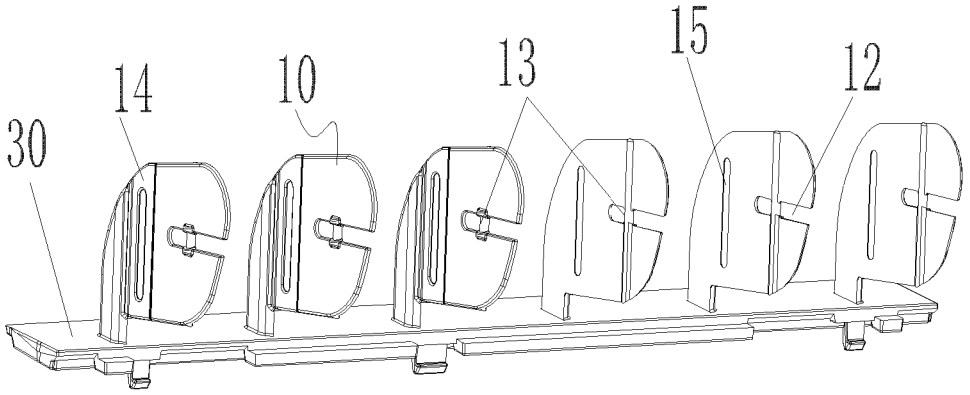
FIG. 4 is a first three-dimensional structure diagram of a blade group assembled by air sweeping blades according to the invention.
Figure 5:
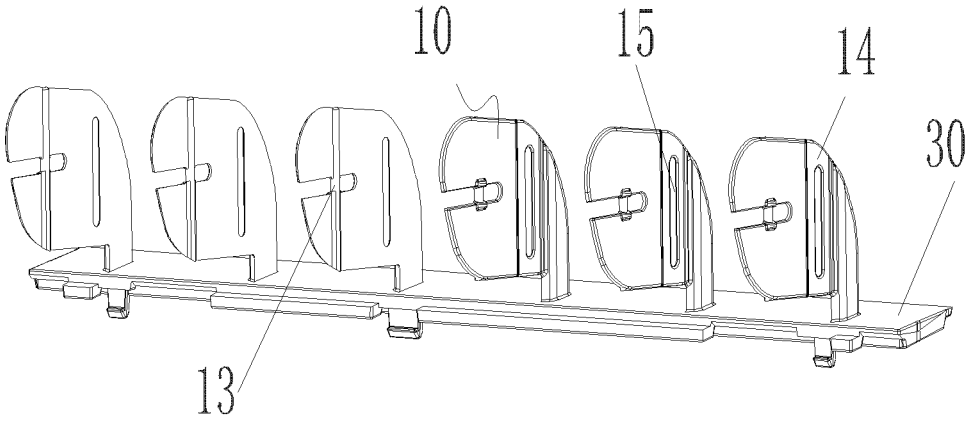
FIG. 5 is a second three-dimensional structure diagram of a blade group assembled by air sweeping blades according to the invention.
Figure 6:
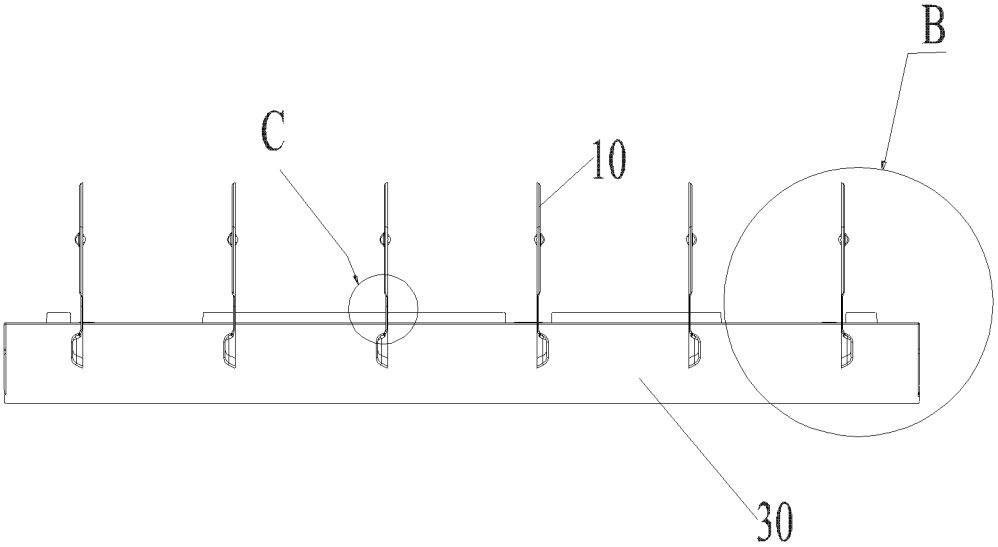
FIG. 6 is a top-view structure diagram of a structure shown in FIG. 5.
Figure 7:
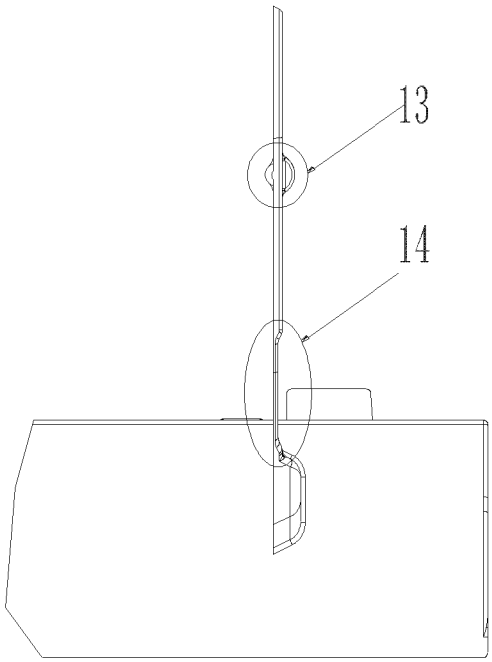
FIG. 7 is a partial enlarged view of a mark B in FIG. 6.

As shown in 2*a*, 2*b*, and FIGS. 4 to 6, the blade body 11 tends to be thin, and the thickness is about 1.5 mm. With the own characteristic of a material, the deformation of the blade formed by injection is difficult to guarantee, the overall rigidity is weak, the defects of collapse and distortion of the blade body easily happens, and the appearance looks not beautiful. In order to improve the deformation of the blade, the rigidity of the blade should be improved. What can be done is that rib is added to the blade for improvement. By adding a reinforcement rib, the rigidity of the blade may be improved, the deformation of the blade body is improved, and the appearance effect is thus beautified.

As shown in 2*b*, the blade body 11 comprising a first side 111 and a second side 112, one end of the two ends of the connecting rod shaft 13 is on the first side 111, and another end of the two ends of the connecting rod shaft 13 through a assembly groove 12 of the blade body 11 continues along the blade body 11 until it reaches the second side 112, the blade body 11 has a flexible area 14, a longitudinal direction of the flexible area 14 is parallel to an axial direction of the connecting rod shaft 13, a transverse direction of the flexible area 14 is perpendicular to the axial direction of the connecting rod shaft 13, the first side 111 of the blade body 11 and the second side 112 of the blade body 11 are arranged opposite to each other in the axial direction of the connecting rod shaft 13, and the two ends of the connecting rod shaft 13 are arranged opposite to each other in the axial direction of the connecting rod shaft 13, and the flexible area 14 has an opening 15 extending along the longitudinal direction thereof, and a width of the opening 15 is a and the width of the opening 15 is oriented in the transverse direction of the flexible area 14, a width of the flexible area is c, a length of the flexible area 14 is e, a length of the opening 15 is b and the length of the opening 15 is oriented in the longitudinal direction of the flexible area 14, the length of the opening 15 is longer than the width of the opening 15.

Similarly, since the thickness of the blade body 11 is relatively thin and is small relative to the diameter of the connecting rod shaft 13, an assembly groove 12 matched with the connecting rod 20 is provided on the blade body 11. When the connecting rod shaft 13 is provided on the assembly groove 12, a root of the connecting rod shaft 13 in combination with the blade body 11 will form steps which cause stress concentration. Connected materials of a combined part there between are few, so when the connecting rod 20 is assembled, if the blade is pulled forcibly, the connecting rod shaft 13 will be easily broken from the root under the action of external force. If the connecting rod shaft 13 penetrates through the whole blade surface or a large part of the blade surface of the blade body 11, the problems of stress concentration and few connected materials of the root of the connecting rod shaft 13 may be solved. Large rounded corners of the connecting rod shaft 13 and the blade body 11 facilitates stress release and strength increase, and the problem of assembly breakage of the connecting rod shaft 13 is practically and effectively improved.

The invention combines the above-mentioned two aspects. The connecting rod shaft 13 extends to the edge of the blade body 11 along the axis and is fixedly connected with the blade body 11, such that the connecting rod shaft 13 penetrates through the whole blade surface or a large part of the blade surface of the blade body 11, and serves as a reinforcement rib of the blade body 11, thereby solving the problems of connection between the connecting rod shaft 13 and the blade body 11 and insufficient rigidity of the blade body 11.

Figure 2A:
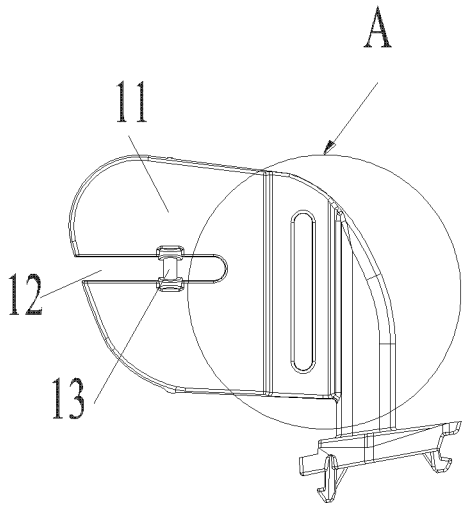
FIG. 2*a* is a first three-dimensional structure diagram of an air sweeping blade according to the invention.

As shown in FIG. 2*a* to FIG. 5, FIG. 9 and FIG. 10, in a specific setting form, the connecting rod shaft 13 may extend on blade surfaces of two sides of the blade body 11, and may extend on the blade surface of only one side as shown in FIG. 2*a*. Preferably, the connecting rod shaft 13 and the blade body 11 are integrally formed, i.e., integrally injected to facilitate processing, and the connecting strength can be improved.

Figure 2B:
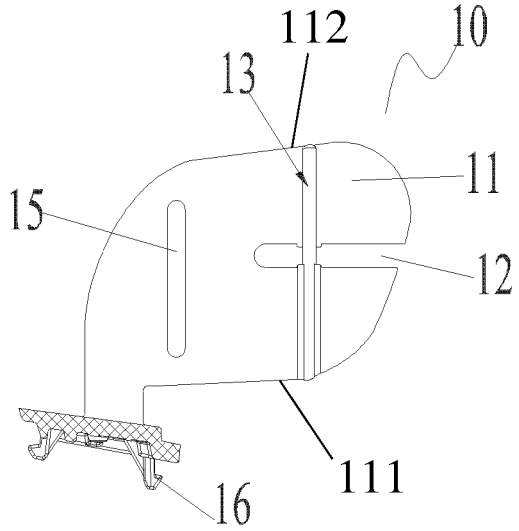
FIG. 2*b* is a second three-dimensional structure diagram of an air sweeping blade according to the invention.
Figure 3:
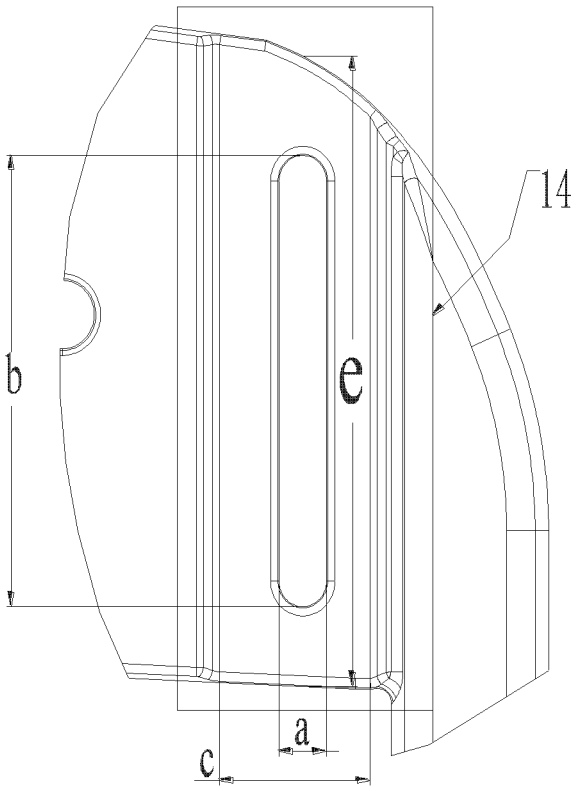
FIG. 3 is a partial enlarged view of a mark A in FIG. 2*a;*

As shown in FIG. 2*a*, FIG. 2*b* and FIG. 3, the air sweeping blade in the invention is a flexible blade. That is, the blade body 11 has a flexible area 14, a length direction of the flexible area 14 is parallel to an axis direction of the connecting rod shaft 13, a width direction of the flexible area 14 is vertical to the axis direction of the connecting rod shaft 13, and the flexible area 14 is flexibly bent during the process of the connecting rod 20 drives the connecting rod shaft 13 movement, so as to change an air guide direction of the blade surface. Preferably, the flexible area 14 has an opening 15 extending along the length direction thereof. The effect of reducing the elasticity of the flexible area 14 can be achieved, so the magnitude of a driving force moment for making the flexible area 14 deform may be reduced.

As shown in FIG. 3, a rotational force moment of the blade body 11 has more to do with the flexible area 14, and the width c of the flexible area 14 influences a rotational radius, and is indirectly feedback to the force moment of the blade. The bigger c is, the better it is. However, a brought injection defect is relatively serious, and a reasonable width is required. Preferably, $e/4 \le c \le e/3$, where e is the length of the flexible area 14.

More preferably, there is one opening 15. Compared with a mode of providing multiple openings 5, this mode may avoid the problem of breakage of middle connection of multiple openings, and may reduce the force moment needed for rotation of the blade. In view of the problems of connecting strength and injection gluing, the width a of the opening 15 is $c/4 \le a \le c/3$, generally.

Figure 8:
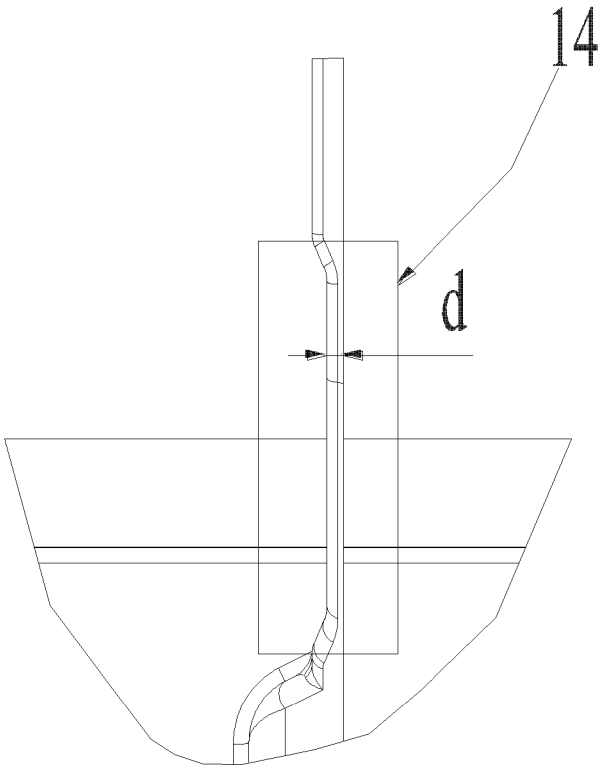
FIG. 8 is a partial enlarged view of a mark C in FIG. 6.
Figure 9:
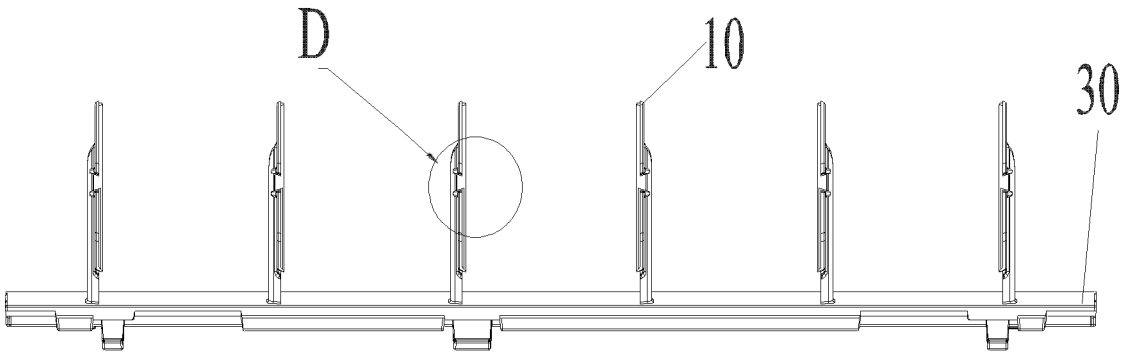
FIG. 9 is a front-view structure diagram of a structure shown in FIG. 5.
Figure 10:
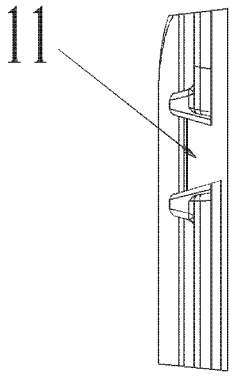
FIG. 10 is a partial enlarged view of a mark D in FIG. 9.

As shown in FIG. 3 and FIG. 8, the thickness of the flexible area 14 is d, the length b of the opening 15 may be calculated according to a formula $$M = \frac{yE(e-b)d^3}{12},$$

the width of a connected part between two ends of the opening 15 is equally divided, and the problem of forming via an injection process can be effectively solved. Meanwhile, the rotational force moment reaches a higher level, wherein M is a preset force moment, which is a maximum rotational force moment provided by an air sweeping stepping motor generally, E is an elastic model of a material of the flexible area 14, and y is a preset offset of the blade body 11, and generally adopts a chord length corresponding to an air sweeping angle at which the blade rotates around an assumed rotational shaft of the flexible area. That is, when product function requirements and the material adopted by the flexible area are determined, M, E and y are constant values, so the length b of the opening 15 may be obtained by inverse estimation according to the formula $$M = \frac{yE(e-b)d^3}{12}.$$

Figure 1:
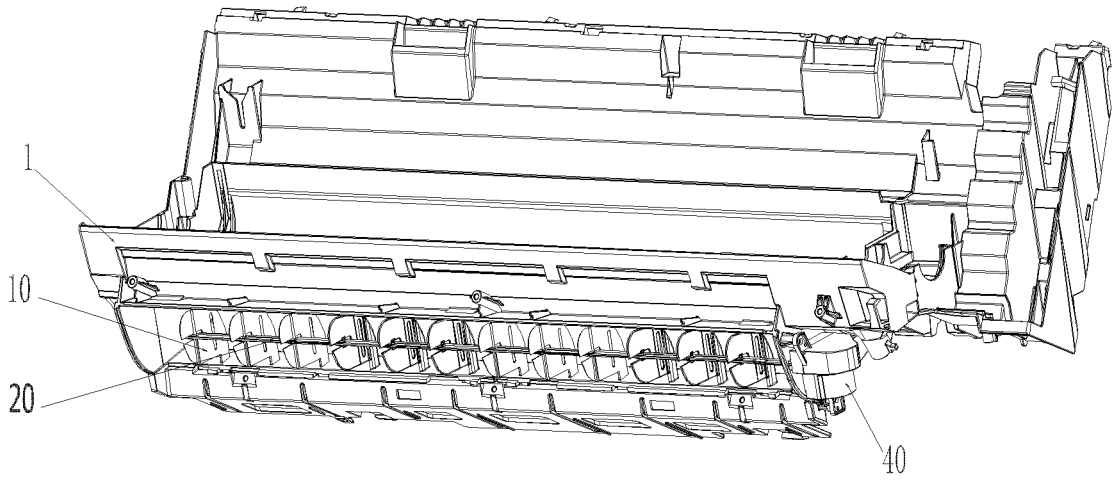
FIG. 1 is a three-dimensional structure diagram of an air conditioner according to the invention.
Figure 11:
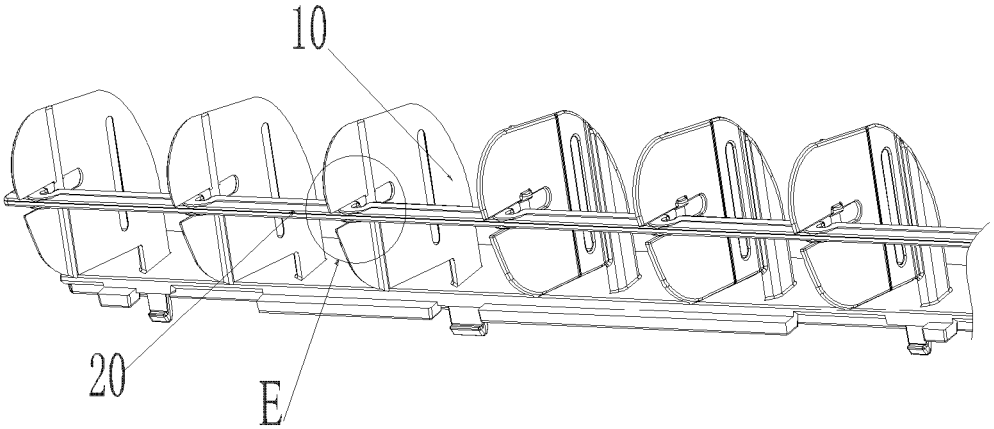
FIG. 11 is a partial three-dimensional structure diagram of an air sweeping mechanism according to the invention.
Figure 12:
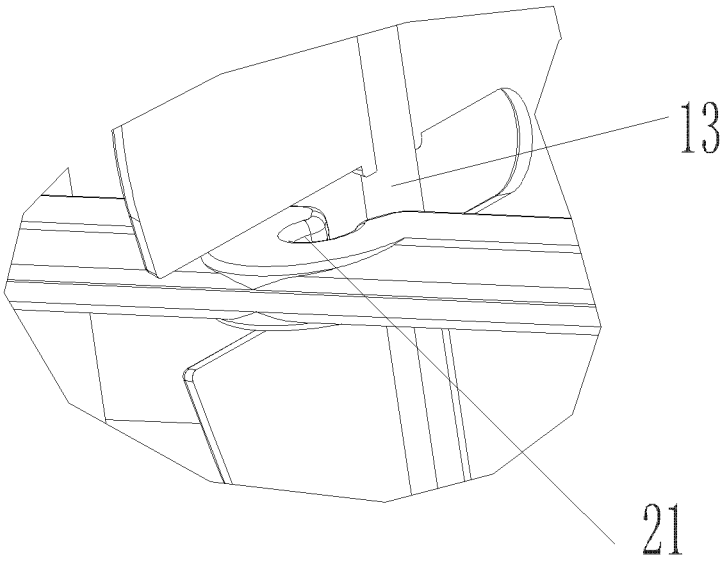
FIG. 12 is a partial enlarged view of a mark E in FIG. 11.

As shown in FIG. 1, FIG. 11 and FIG. 12, the invention also provides an air sweeping mechanism, which comprises a blade clamping board 30, a connecting rod 20 and a motor assembly 40 for driving the connecting rod 20. Multiple aforementioned air sweeping blades 10 are provided on the blade clamping board 30. Connecting rod shafts 13 of the multiple air sweeping blades 10 are rotationally connected with the connecting rod 20. The problem of insufficient strength of the blade can be effectively solved, and the problem of breakage of the root of the connecting rod shaft 13 is also solved.

As shown in FIG. 12, a rotational clamping groove 21 is provided on the connecting rod 20, and a connecting rod shaft 13 is clamped into the rotational clamping groove 21, so the connecting rod 20 is in rotational match with the connecting rod shaft 13 to drive the blade to swing so as to sweep air.

As shown in FIG. 2*a*, FIG. 2*b*, FIG. 4, and FIG. 5, a clamping hole is provided on the blade clamping board 30, and a clamping jaw 16 clamping fixed with the clamping hole is provided on the air sweeping blade 10. During assembly, the clamping jaw 16 penetrates through the clamping hole and clamp in the edge of the clamping hole, and the connection is convenient and reliable.

As shown in FIG. 1, the invention also provides an air conditioner, which comprises a base 1. The aforementioned air sweeping mechanism is provided on the base 1, so the reliability can be effectively improved.

From the above description, it may be seen that the above embodiment of the invention achieves the following technical effects.

According to the air sweeping blade, the air sweeping mechanism and the air conditioner of the invention, the connecting rod shaft extends to the edge of the blade body along the axis and is fixedly connected with the blade body. On one hand, the problem of connection between the connecting shaft and the blade body is solved, the reliability is improved, and the condition of breakage caused by pulling during assembly is avoided; and on the other hand, the connecting rod shaft extends to the edge of the blade body and also serves as a reinforcement rib of the blade body, thereby improving the rigidity of the blade body, and preventing the blade body from distorting.

The above is only the preferred embodiments of the invention, and not intended to limit the invention. There can be various modifications and variations in the invention for those skilled in the art. Any modifications, equivalent replacements, improvements and the like made within the spirit and principle of the invention shall fall within the scope of protection of the invention.

The invention claimed is:

1. An air sweeping blade configured to connect with a connecting rod, the air sweeping blade comprising a blade body, and a connecting rod shaft on the blade body, wherein each of two ends of the connecting rod shaft extends to an edge of the blade body along an axis of the connecting rod shaft and is fixedly connected with the blade body, and the blade body comprising a first side and a second side, the connecting rod shaft extending through an assembly groove of the blade body such that one end of the two ends of the connecting rod shaft is on the first side and another end of the two ends of the connecting rod shaft is on the second side, the blade body has a flexible area, a longitudinal direction of the flexible area is parallel to an axial direction of the connecting rod shaft, a transverse direction of the flexible area is perpendicular to the axial direction of the connecting rod shaft, the first side of the blade body and the second side of the blade body are arranged opposite to each other in the axial direction of the connecting rod shaft, and the two ends of the connecting rod shaft are arranged opposite to each other in the axial direction of the connecting rod shaft, and the flexible area has an opening extending along the longitudinal direction thereof, and a width of the opening is a and the width of the opening is oriented in the transverse direction of the flexible area, a width of the flexible area is c, a length of the flexible area is e, a length of the opening is b and the length of the opening is oriented in the longitudinal direction of the flexible area, the length of the opening is longer than the width of the opening, the length of the flexible area is longer than the width of the flexible area, and wherein $$\frac{e}{4} \le c \le \frac{e}{3}.$$

2. The air sweeping blade according to claim 1, wherein the connecting rod shaft and the blade body are integrally formed.

3. The air sweeping blade according to claim 1, wherein $$\frac{c}{4} \le a \le \frac{c}{3}.$$

4. The air sweeping blade according to claim 2, wherein $$\frac{c}{4} \le a \le \frac{c}{3}.$$

5. The air sweeping blade according to claim 3, wherein the length b of the opening satisfies a formula:

$$M = \frac{yE(e-b)d^3}{12},$$

wherein d is a thickness of the flexible area, M is a preset moment of force, E is an elastic modulus of a material of the flexible area, and y is a preset offset of the blade body.

6. The air sweeping blade according to claim 4, wherein the length b of the opening satisfies a formula:

$$M = \frac{yE(e-b)d^3}{12},$$

wherein d is a thickness of the flexible area, M is a preset moment of force, E is an elastic modulus of a material of the flexible area, and y is a preset offset for the blade body.

7. An air sweeping mechanism, comprising a blade clamping board, the connecting rod, and a motor assembly for driving the connecting rod, wherein multiple air sweeping blades according to claim 1 are provided on the blade clamping board, and the connecting rod shafts of the multiple air sweeping blades are rotatably connected with the connecting rod.

8. The air sweeping mechanism according to claim 7, wherein a rotational clamping groove is provided on the connecting rod, and one of the connecting rod shafts is clamped into the rotational clamping groove.

9. The air sweeping mechanism according to claim 7, wherein a clamping hole is provided on the blade clamping board, and a clamping jaw clamping fixed with the clamping hole is provided on one of the multiple air sweeping blades.

10. An air conditioner, comprising a base, wherein the air sweeping mechanism according to claim 7 is provided on the base.

* * * * *